United States Patent [19]

Taggart

[11] 4,434,983

[45] Mar. 6, 1984

[54] GOLFER'S STANCE MAT

[76] Inventor: Franklin K. Taggart, P.O. Box 246, Hydeville, Vt. 05750

[21] Appl. No.: 430,311

[22] Filed: Sep. 30, 1982

[51] Int. Cl.[3] ..... A63B 69/36

[52] U.S. Cl. ..... 273/187 R; 273/291; 273/DIG. 31

[58] Field of Search ..... 273/187 R, 187 A, DIG. 31, 273/291

[56] References Cited

U.S. PATENT DOCUMENTS 3,784,208 1/1974 Weygandt ..... 273/187 A X
4,384,718 5/1983 Cachola ..... 273/187 R

FOREIGN PATENT DOCUMENTS 1305710 7/1973 United Kingdom ..... 273/187 R

*Primary Examiner*—George J. Marlo
*Attorney, Agent, or Firm*—Sughrue, Mion, Zinn, Macpeak and Seas

[57] ABSTRACT

A rectangular mat having a side edge extending generally parallel to the flight direction of a golf ball is fixed to the ground for fore and aft reversible orientation, fixedly mounts a tee bar type golf swing guide member in strip form on the upper surface of the mat including a base strip defining the golfer swing path and bearing multiple tee positions along its length to the right and left of a center strip guide leg extending perpendicularly outwardly therefrom. The guide leg bears an adjustably positioned foot placement member along the length of the guide leg and controlling the position of the golfer's feet to respective sides of the center guide leg and at a desired distance from the base strip. A face reversible tee placement instruction strip is removably mounted to the upper surface of the mat and bears indicia relative to the tee placement positions for right and left handed golfers on respective faces thereof. The mat is reversed fore and aft and the instruction strip upturned and reverse face mounted to the mat to meet driving range requirements for servicing both right and left hand golfers.

2 Claims, 2 Drawing Figures

GOLFER'S STANCE MAT

FIELD OF THE INVENTION

This invention relates to golf practice devices, and more particularly to a reversibly positioned golf teaching device, permitting use at driving ranges and the like by golfers of different physical size and weight and irrespective of whether they are right handed or left handed.

BACKGROUND OF THE INVENTION

Over the years, a number of golf practice devices have been formulated to assist in facilitating a golfer to properly address and hit a golf ball from a tee or the like, irrespective of the size golf club selected. This permits the golfer to develop a controlled swing in which, during play of an actual round of golf, the golfer approaches the ball and initiates a golf swing which is essentially the same for a selected club with uniform drive to the golf ball. As may be appreciated, in order to insure consistency, unless purposely the golfer desires to drive the ball along a line of flight or path other than parallel to the swing and stance of the golfer, i.e. for controlled slicing, hooking, etc., the golf club should be swung in a manner such that the face of the club head impacts the golf ball with the face perpendicular to the line of flight at the moment of impact. Further, irrespective of the golf club is a wood or iron, a developed reproducible swing permits accurate control of the flight of the golf ball with repetitive accuracy. Since golf clubs are made to measure, the clubs vary in length, the faces of the clubs have varying angulation and the swing of the club relative to the feet position of the golfer further varies, depending upon these factors and the height of the golfer, etc. The creation of the developed golf swing not only takes time, but is complicated by the fact that the golfer, absent coaching must attempt, without any further assistance, the reproduction of his swing at various positions along the golf course, all of which are complicated by terrain variations and difference in type of hitting surface.

To facilitate the creation and maintenance of a controlled accurate and reproducible swing, golfers invariably employ golf ranges for individual practice. The driving range consists of a number of driving locations where the golfers are aligned at one end of the golfing range in a row, all face the same direction and drive the ball generally perpendicular to the aligned row of drivers. Many of the golfing ranges have prescribed driving positions created by rectangular or other configured mats formed of rubber, vinyl, artificial turf or the like, and in which in some cases tee placement positions are defined by a short length flexible tube such as rubber functioning as a fixed tee. This requires placement of the golf ball at an identical position irrespective of the club employed. Normally, no golf teaching or instruction mechanisms are employed, and the golfer hits a number of golf balls attempting to achieve reproducibility and controlled flight of the golf ball without benefit of knowing whether during each repetitive swing, his position feetwise and clubwise is close placementwise to that achieved during the prior swing.

A number of golf teaching devices or practice devices have been developed to assist in achieving both accuracy and reproducibility of the golf swing. While no means a complete collection of such devices, prior art devices are exemplified by the following U.S. patents which will be discussed in some detail and do have application as prior art to the present invention.

U.S. Pat. No. 2,150,580 to R. Crowley issuing Mar. 14, 1939, is directed to a golf teaching and practicing device which takes the form of a number of interconnected sliding guide rods bearing rulerlike scale indicia creating a cruciform array. Paired parallel guide rods in the area of golf head swings which are interposed parallel to the swing path to opposite sides of the same, and adapted to receive a golf ball therebetween. This permits, by way of a cruciform connection, a foot stance position rod which is adjustable to aid in creating a reproducible golf swing. Such a device is complicated in that the position of the golf ball relative to the foot position of the golfer is indirectly identified by scale indicia carried by five interconnected, adjustably mounted bars, the device is cumbersome and appears to interfere with the actual golf swing.

U.S. Pat. No. 2,777,697 to E. A. Crossot issuing Jan. 15, 1957, shows a simplified arrangement in which a mat upon which the golfer stands is provided with fixed foot imprints defining foot positions for the golfer. A single flexible strip extends generally at right angles to the mat itself from the edge facing in the direction of the golf ball flight path and bears fixed defined iron and wood swing positions. The strip is movable laterally and positioned relative to the further indicia carried on the mat edge related to club length. While the device attempts to appropriately index proper stance of the golfer, and while the placement of the golfer's feet and the ball serves perhaps a majority of golfers, it represents, at best, an averaging situation for golf instruction to all golfers. Such systems must inherently fail and are useless to golfers who don't fit the average mold.

U.S. Pat. No. 3,300,219 to Sipos issuing Jan. 24, 1967, represents an even further, more rigid or inflexible training device. In that patent, a tee bar is provided with a base strip bearing at opposite ends rigid outlines for placement of the golfers feet, while a strip extending outwardly of the base and away from the foot position elements bears a number of holes defining for positioning of a tee whose position cannot vary right or left, but can only be extended away from the golfer in an attempt to control and fix the golfer's stance and swing position. While such devices may have utility for individual golfers, they are hardly adequate for a driving range, and cannot possibly apply to different woods and irons requiring tee placement to the right or left of the driver, depending upon the club selected.

U.S. Pat. No. 3,887,193 to Stanley issuing June 3, 1975, is directed to a more sophisticated golf practice device to which mounts a turflike mat bearing a plurality of literally disposed ball support means. It provides some flexibility in laterally shifting one element of an L-shaped guide relative to the other. The golf practice device fails to differentiate for golfers of varying height and makes no effort to satisfy the needs of both left and right handed golfers.

It is therefore a primary object of the present invention to provide a reversibly positionable golf teaching device for driving ranges and the like which permits a golfer to assume for any given club a fixed and proper stance which may be easily achieved by the utilization of scale indicia which readily identifies by one scale the tee position for the golf ball for a given size club or iron and its placement relative to further scales proper positioning of the driver's feet.

SUMMARY OF THE INVENTION

The present invention is directed to a reversibly positionable golf teaching device for a driving range and the like comprising a rectangular planar mat for ground or floor positioning and for reversible orientation, fore and aft, depending upon whether the golfer is right or left handed. Fixedly mounted to the mat is a tee bar strip assembly comprising a base strip extending parallel to one side edge of the rectangular oriented in the direction of flight of the ball, the base strip including a plurality of tee mounting positions extending generally the length of the base. A center strip integral with and extends at right angles to the base strip, away from the base. A foot placement guide is adjustably mounted to the center strip longitudinally of the same and spans across the same. Indicia scales carried by the base strip, center strip, and foot placement guide member identify defined positions for the golfer's feet to opposite sides of the center strip and at given positions relative to the indicia carried by the foot placement guide. A tee placement instruction strip is face reversibly mounted to the mat parallel to and outside the base strip of the tee bar guide assembly and bears indicia on opposite faces thereof identifying wood and iron tee placement positions for the base strip such that the golfer by reference to the indicia on the base strip, the center strip and the feet placement guide may exactly position the tee and the driver's feet on the mat to insure controlled, accurate and reproducible golf swings for a selected club irrespective of mat orientation to facilitate use by both right and left handed golfers. The base strip may carry holes at predetermined scale positions for receiving a conventional golf tee for ball placement. Alternatively, the upper surface of the base strip may comprise one Velcro member and a golf tee may be fixed at its base to a downwardly facing Velcro covered disc, permitting fixing of the tee at adjustable positions along the length of the base strip.

DESCRIPTION OF THE PREFERRED EMBODIMENT

Figure 1:
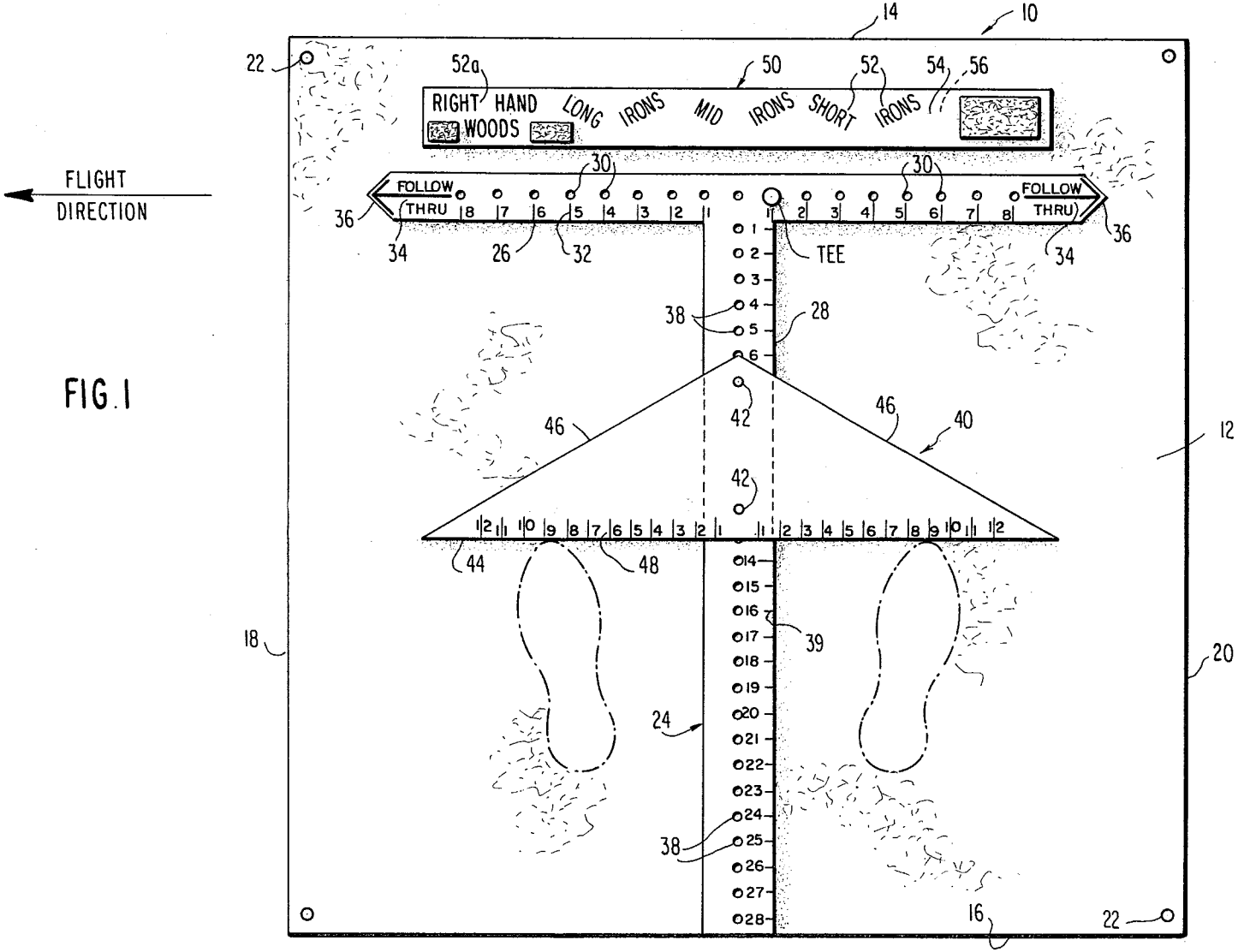
FIG. 1 is a top plan view of a reversibly positionable golf teaching device forming a preferred embodiment of the present invention set up for a right handed golfer.

Reference to the figures shows a preferred embodiment of a reversibly positionable golf teaching device indicated generally at 10, the device 10 being particularly applicable to driving ranges and the like, although it may be employed in the home and may be used both for indoor and outdoor use. Device 10 is comprised principally of a rectangular (preferably square) base mat or planar member 12 formed of heavy vinyl, rubber, artificial turf or similar product. It is defined by a front edge 18 relative to the direction of flight of the ball, a rear edge 20, and laterally opposed side edges 14 and 16. The base mat 12 includes holes as at 22 at the four corners, permitting nails or other fasteners to project therethrough for fixedly locating the base mat 12 in position within a defined area of ground G of a golf driving range or the like. As a matter of fact, a series of mats may be employed at in line golf driving stations, wherein one side edge 14 of one mat is spaced some distance from side edge 16 of an adjacent mat, several to ten feet away, and wherein all of the mats have either their front edges 18 or their rear edges 20 facing in the direction of flight of the ball.

The golf teaching device 10 comprises a plurality of planar members including base mat 12. In that respect, all of the principal elements of the assembly may comprise flexibly plastic elements. A tee bar element 24 is formed of intersecting strip members consisting of a tee mounting base strip 26 and a center strip 28 which is integral therewith and which extends at right angles thereto. The base strip 26 includes a plurality of tee placement holes as at 30 running longitudinally the length of the same from one end to the other or in a line starting near one end and extending nearly to the other, to both sides of the center strip 28. A first scale 32 may comprise lines or scale indicia one inch apart and which may be numbered as at 1, 2, 3, 4, 5, 6, etc. extending along the edge of the base strip 26 along either the top or the bottom of the strip and at positions corresponding to the holes 30 within which a tee may be placed. Preferably instruction data as at 34 is provided at the opposite ends of the base 26. The base strips may in fact be pointed as at 36 at the ends and the indicia 34 may comprise the phrase "Follow Through" readily visible to the driver. As may be appreciated, the "Follow Through" indicia 34 is provided at both ends of the base strip 26 since the device is universal and may be employed both by right and left handed golfers or drivers by rotating mat 12, 180°. The Center strip 28 is provided with a number of holes 38 which function to receive pins carried by a foot placement guide 40 permitting the adjustable positioning of the foot placement guide. The foot placement guide 40 is a triangular planar element formed of flexible or rigid plastic or the like and which bears on the bottom surface thereof a series of downwardly projecting pins 42 which are receivable within holes 38. The holes 38 are evenly spaced at positions approximately one inch from each other, for instance, and an appropriate scale 39 is provided. Scale 39 is similar to the scale 32. The foot placement guide 40 is illustrated as being triangular in form including a base edge 44 and inclined intersecting side edges 46. The width of the triangular shaped foot placement guide 40 may be several feet, being sufficiently wide to cover the normal stance of a golfer. Adjacent base edge 44, the foot placement guide 40 is provided with a third scale as at 48 again appropriately numbered by numbers 1, 2, 3, 4, etc. similar to the indicia of scales 32 and 39.

As may be appreciated, the foot placement guide 40 is adjustably positioned, i.e. snapped into place on the center strip 28 at a selected distance from the base strip 26 depending upon the club selected and the size of the golfer using the same.

The function of the reversibly positionable golf teaching device 10 is to guide the golfer or driver in positioning the ball and the positioning of his feet relative to the path or trajectory of the golf head as the golfer swings the club across the ball carried tee. In that respect, the invention further comprising the utilization of a face reversible swing instruction strip indicated at 50, which bears suitable written indicia as at 52 identifying individual tee positions for the woods, long irons, mid-irons and short irons to the left and right of the center strip, starting with the woods and terminating with the shorter irons for the right handed golfer, FIG. 1. The instruction strip 50 extends generally the length of the base strip 26, is positioned parallel thereto and the indicia 52 includes a portion **52*a*** with the intials "RH"

or full writing "Right Hand" indicating that the golfer utilize the instruction strip 50 as positioned, FIG. 1, assuming he is a right handed golfer and is driving from right to left to drive the ball away from the front edge 18 of the base mat 12. Both the upper surface 54 and lower surface 56 of instruction strip 50 may bear a Velcro face or portions thereof in Velcro and the base mat 12 may have a full Velcro strip or partial areas of interjoining Velcro on its upper face adjacent to the base strip 26 of the tee bar 24. This permits the simple face reversal change of the instruction strip 50 when the mat is to be employed by a left handed golfer, FIG. 2, in contrast to a right handed golfer, FIG. 1, with the accompanying fore and aft change in position of base mat 12.

Figure 2:
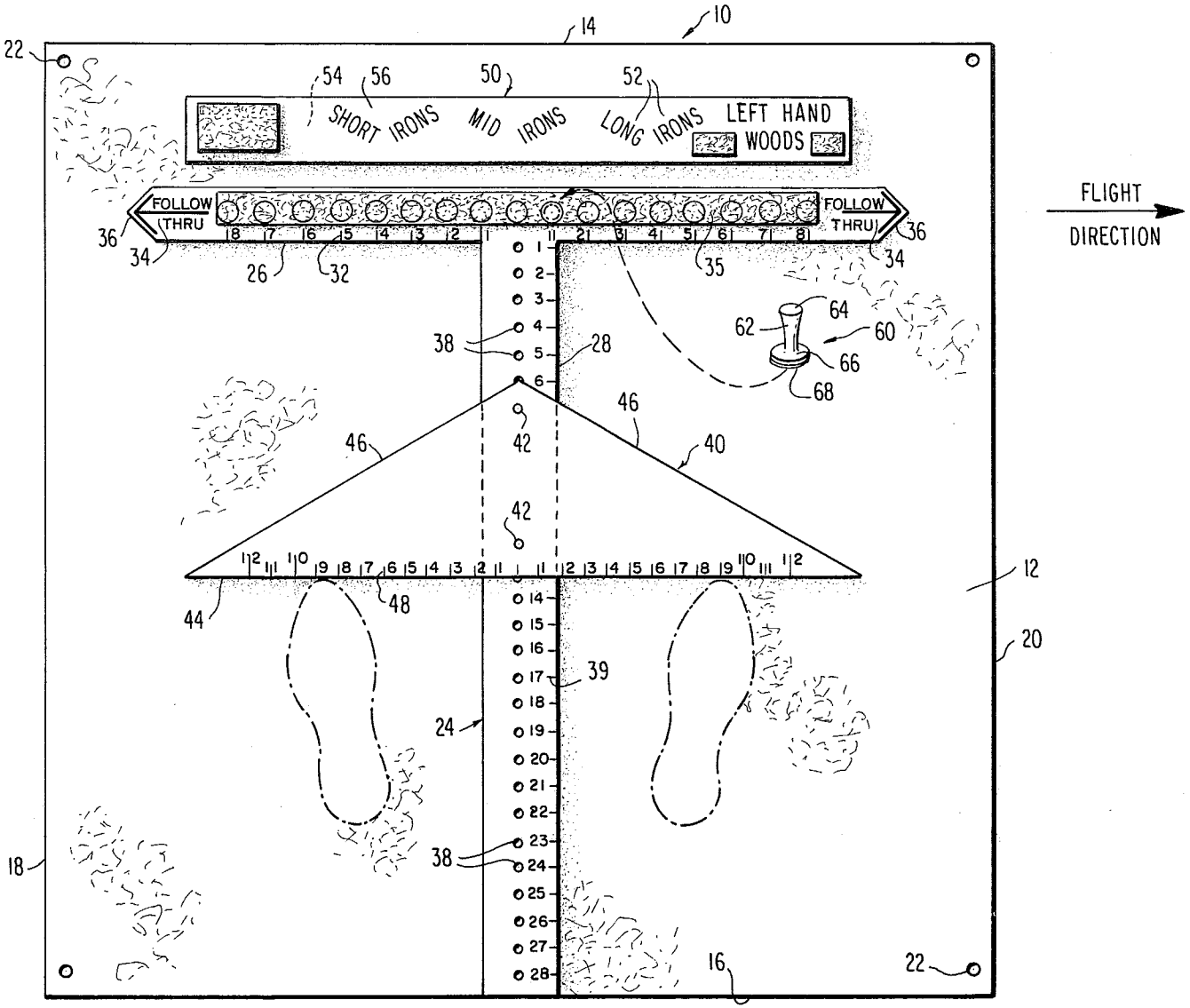
FIG. 2 is a top plan view of the embodiment of FIG. 1 modified for use by a left handed golfer.

As will be noted in FIG. 2, the base mat 12 has been rotated 180° so that the so-called front edge 18 moves to the rear and the rear edge 20 moves to the front facing the direction of the ball to be hit and wherein the tee bar 24 remains in position and everything else is oriented properly for the new left handed golfer or driver. The driving range operator or the golfer himself also face reverses strip 50 so that he properly positions the tee at the proper hole 30 along the line of holes 30 for receiving the tee at a position indicated by instruction strip 50 corresponding to the club selected. When a club is changed, of course, it may be necessary to adjust the position of the foot placement guide 40 further towards or further back from the flight path of the golf head as defined by the strip of tee placement holes 30 within base strip 26 of the tee bar. For the woods, the foot placement guide 40 must be moved away from the base strip 26 on the tee bar center strip 28 and for the shorter woods and irons, the foot placement guide 40 must be moved closer to base strip 26, permitting the driver to get closer to the ball supported by the tee within the tee receiving hole 30.

As may be appreciated, the illustrated embodiment in FIG. 1, is set up for a right hand driver or golfer and utilizes the holes 30 for directly receiving the shank or stem of a standard tee. A modified tee may be employed in the same embodiment, FIG. 2. In this case it should be pointed out that the upper surface of the base strip 26 is provided with a Velcro layer as at 35 and the tee indicated generally at 60 is comprised of a standard tee stem 62 terminating in a flared cup 64 and the tee is provided with a disclike base 66 bearing a mating Velcro layer or surface covering as at 68 on the bottom thereof. In this case, the tee 60 may be moved from position to position as defined by the first scale 32 when changing from woods to irons and vice versa, and in that case, the drilled holes may be eliminated or disregarded within base strip 26. As may be appreciated, the simplified system is in planar strip form, applied to a mat which may be readily shifted fore and aft, i.e. rotated 180° when changing from a right hand to a left hand golfer, each tee position is readily identifiable scalewise. The position of the foot placement guide 40 defined both by way of the apex for side edges 46 at an identifiable scale position from the base strip 26 along center strip 28 identified by scale 39 and the golfer's feet are positioned to opposite sides of the center strip 28 at positions readily identifiable to the golfer by way of indicia of scale 48 along the base edge 44 of that member.

All of the parts may be readily independently made and appropriately provided within a kit form. While certain of the surfaces have been defined as constituting Velcro to effect detachable fixing of strips such as instruction strip 50 to the upper surface of base mat 12 and the utilization of a Velcro surface on the face of disc 66 for detachably mounting to a Velcro covered upper surface to base strip 26 of tee bar 24, other means may be employed such as pressure sensitive adhesive to opposite faces of instruction strip 50 and to the base of disc 66 for detachably fixing these elements in place.

Additionally, while the invention has been described in terms of fixing or bonding tee bar 24 in face to face contact with the upper surface of the base mat 12, pressure sensitive adhesive may be provided to the rear surface of tee bar 24 to achieve removability of that element.

While the invention has been particularly shown and described with reference to a preferred embodiment thereof, it will be understood by those skilled in the art that various changes in form and details may be made therein without departing from the spirit and scope of the invention.

What is claimed is:

1. A golf teaching device for driving ranges and the like, said device comprising in combination:

a rectangular base mat having front and rear edges generally at right angles to the flight path of a golf ball to be driven in conjunction therewith;

a tee bar mounted to the upper surface of the base mat and including a base strip defining the swing path for the head of a golf club being swung by a driver standing on said base mat and generally facing the base strip;

said tee bar further including an integral center strip extending at right angles to said base strip and outwardly to one side thereof from the center thereof generally parallel to the front and rear edges of the base mat;

a first scale carried by said base strip for indicating specific tee positions for tee placement on the base strip to the right and left of the center strip;

said center strip including a second scale extending the length of the same;

a feet placement guide adjustably mounted to the center strip at a longitudinal position therealong to effect a proper placement for the golfer's feet to opposite sides of the center strip and bearing a third scale along an edge thereof at right angles to the longitudinal axis of the center strip;

a tee position instruction strip reversibly face mounted to the upper surface of said base mat positioned adjacent to said base strip and to the side opposite the center strip and bearing indicia on each face thereof representing the desired proper tee positions for a set of golf clubs; and wherein said center strip comprises a series of pin placement holes, said feet placement guide comprises a triangular planar member including a base edge remote from the base strip of the tee bar and bearing indicia to the right and left of a center line through the apex of the triangular planar member along said base edge to identify golfer's foot positions to the right and left of said center strip and behind the base edge on said rectangular base mat, and wherein said triangular planar member is detachably mounted to the tee bar strip by means of aligned pins projecting from the bottom surface for the foot placement guide at the center thereof and receivable within given pin placement holes formed within said center strip;

whereby, a golfer may readily take identical stance positions from time to time by way of said scales and tee placement positions for a given golf club, and wherein the assembly may be utilized both by right handed and left handed golfers by the simple expedient of assuming a position either fore or aft on the mat and face reversal of the instruction strip whose iron and wood tee positions are reversed relative to the base strip with respect to the direction of flight of the golf ball.

2. The combination as claimed in claim 1, further comprising a tee and wherein said tee comprises a stem terminating in a flared concave recess for receiving said ball at its upper end, and fixidly bearing a disc at the stem base, said disc being at right angles to the axis of said stem, and wherein the upper surface of the base strip of said tee bar comprises a Velcro covering, and wherein a mating Velcro surface is borne by said tee base on the bottom surface thereof such that said tee is fixed Velcrowise to said base strip at a desired position therealong depending upon the club selection by the driver.

* * * * *